United States Patent [19]

Hahn

[11] Patent Number: 4,491,613

[45] Date of Patent: Jan. 1, 1985

[54] BASE COAT APPLICATOR

[75] Inventor: Roger Hahn, Arvada, Colo.

[73] Assignee: Adolph Coors Company, Golden, Colo.

[21] Appl. No.: 525,060

[22] Filed: Aug. 22, 1983

[51] Int. Cl.[3] ..... B05D 1/28; B05C 1/08

[52] U.S. Cl. ..... 427/428; 118/230; 118/232; 118/218; 118/219; 118/223

[58] Field of Search ..... 118/46, 230, 232, 218, 118/219, 223; 427/428

[56] References Cited

U.S. PATENT DOCUMENTS

| | | | |
|---|---|---|---|
| 3,855,967 | 12/1974 | Skrypek et al. | 118/230 |
| 4,092,949 | 6/1978 | Balordi | 118/232 X |
| 4,095,556 | 6/1978 | Dawson et al. | 118/230 |
| 4,271,216 | 6/1981 | Shimizu | 118/230 X |
| 4,370,943 | 2/1983 | Watanabe et al. | 118/230 X |

OTHER PUBLICATIONS

Catalog from Van Dam Machine, "Rembrandt", Model 760-6 Color Can Decorator, Model 760-B Can Base Coater, pp. 1-7, 25, 26, 28-31.

*Primary Examiner*—Shrive P. Beck

*Attorney, Agent, or Firm*—Klaas & Law

[57] ABSTRACT

A base coat applicator utilizing an in-feed chute which provides supply of cans which are mounted on mandrels for application of base coat material by applicator wheels. The mandrels are rotated so that surface speed of the cans matches the applicator wheel speed to prevent smearing. Independent control of the inventory production speed of the base coat applicator machine and the applicator wheels allows any desired number of base coat layers to be applied to the cans. Two applicator wheels are used to reduce surface speeds to prevent misting and slinging of base coat material from the applicator wheels and can surfaces. The applicator assembly is automatically withdrawn when the supply of cans is not present and can be manually withdrawn by the operator to prevent application of base coat material to cans or empty mandrels. Disk transfer unit is utilized to transfer the coated cans to a deco pin chain.

12 Claims, 4 Drawing Figures

BASE COAT APPLICATOR

BACKGROUND OF THE INVENTION

The present invention pertains generally to systems for applying a coating material to a cylindrical object and more particularly to a base coat applicator for applying a base coat material to beverage cans.

Base coat applicator systems are used in the beverage container fabrication industry to apply a base coat material of a pre-determined thickness to the outer portions of a beverage container to provide a decorative background upon which a label can be applied. Depending upon the particular label to be applied, various thicknesses of base coat are required to provide the proper background appearance. Some labels require numerous or multiple layers of base coat material to achieve the proper decorative appearance of the can after the label is applied, while other cans may only require one or two layers of base coat material.

A disadvantage of conventional base coat applicator machines is that a single drive unit is used to drive both applicator wheels and turrets such that the machine is designed to apply a pre-determined number of base coat layers. The machine must, consequently, be modified to change the number of base coat layers applied. This results in costly down time if production line changes are desired to modify the appearance of a can or to process cans for different uses in a single production line. In this manner, flexibility of conventional base coat applicator devices is limited.

Additionally, since conventional base coat applicators use a common drive system for both the applicator wheel and turret, the speed of operation of the applicator wheel is directly dependent upon the inventory production speed of the applicator, i.e., the speed at which the applicator processes cans. At high inventory production speeds, an applicator wheel of a conventional base coat applicator must rotate at high speeds, especially where multiple layers must be applied to the can. High rotational speeds of the applicator wheel result in misting and slinging of the base coat material from the applicator wheel surface.

Another disadvantage of prior art base coat applicators is that drying of base coat material on various machine parts occurs if the machine must be shut down for any reason. This greatly delays restart of the system since base coat material must be removed before the base coat applicator can be used again.

Additionally, in order to achieve equal surface speeds between the can surface and the surface of the applicator wheel, drive wheels are employed in conventional base applicators which are substantially concentric with the applicator wheel. These drive wheels engage the mandrel substantially simultaneously with the engagement of the can and applicator wheel surface. Smearing of base coat material on the surface of the can occurs unless the mandrel reaches full rotational speed nearly instantaneously. Smearing of base coat material increases with increased inventory production speeds.

SUMMARY OF THE INVENTION

The present invention overcomes the disadvantages and limitations of the prior art by providing a base coat applicator which employs independent control of applicator wheels and mandrel turret to independently control inventory production speed from operational speed of applicator wheels. This allows application of any desired number of base coat layers regardless of the inventory production speed of the base coat applicator system.

The present invention also utilizes multiple applicator wheels so that equivalent amounts of base coat material can be applied to cans with applicator wheel surface speeds of approximately one half the surface speed of a single applicator wheel. At high inventory production speeds, this substantially eliminates misting and slinging of base coat material as is prevalent in conventional base coat applicators using a single applicator wheel.

The present invention also employs a system for automatically withdrawing the applicator assembly during temporary shut down of the base applicator system or when no cans are present at the infeed chute. The applicator assembly continues to idle so that base coat material does not dry on applicator wheels, engraved wheels, scavenger wheels, etc. This prevents delay in restarting the system.

Additionally, the present invention uses a spin belt which engages the mandrels before the mandrels engage the drive wheel. The spin belt functions to increase the rotational speed of the mandrel so that the drive wheel couples to the mandrel without slippage, to prevent smearing of base coat material on the surface of the can at initial engagement.

The present invention may therefore comprise an apparatus for applying coating material to a cylindrical object comprising: mandrel means for holding the cylindrical objects; multiple applicator assembly means for applying the coating material to the cylindrical objects in a predetermined position while maintaining rotational speeds sufficiently low to prevent misting and slinging of the coating material; first drive means for moving the mandrel means along a predetermined path at a predetermined inventory production speed; second drive means for operating the multiple applicator assembly means at a predetermined operational speed; means for removing the multiple applicator assembly means from the predetermined position and maintaining the operational speed of the applicator assembly means independently of the inventory production speed of the first drive means.

The present invention may also comprise an apparatus for applying multiple base coats to a cylindrical container at high inventory production speeds while maintaining operational speeds sufficiently slow to substantially eliminate misting and slinging of base coat material comprising: mandrel means for holding the container on a rotatable axis; turret means for transporting the mandrel means along a predetermined path; spin belt means for rotating the mandrel means by contacting the mandrel means while the spin belt means is moving; applicator assembly means disposed to contact the container along predetermined portions of the predetermined path to apply the base coat material to the container; additional applicator assembly means disposed to contact the container along additional predetermined portions of the predetermined path to apply additional coats of the base coat material to the container, whereby the applicator assembly means and the additional applicator assembly means are capable of applying equivalent amounts of base coat material to the container as a single applicator assembly operating at twice the rotational speed of the applicator assembly means and the additional applicator assembly means; drive means for varying inventory production speed and operational speed independently to control the amount of the base coat material applied to the container independently of the inventory production speed; means for removing the applicator wheel means from said predetermined portions of said predetermined path and the additional applicator wheel means from said additional predetermined portions of said predetermined path while maintaining said operational speed to prevent drying of base coat material on said applicator assembly means regardless of said inventory production speed.

The present invention may also comprise an apparatus for applying a variable number of multiple coats of base coat material to a beverage can independently of inventory production speed of the apparatus and for maintaining operational speeds of the apparatus sufficiently slow to prevent misting and slinging of the base coat material while simultaneously operating the apparatus at high inventory production speeds comprising: mandrel means for holding the can; spin belt means for initiating rotational motion of the mandrel means by movement of the spin belt in contact with mandrel means to provide a predetermined rotational speed of the mandrel means; first drive wheel means for engaging the mandrel means to rotate the mandrel means at the predetermined rotational speed sufficient to produce a predetermined surface speed of the beverage can; first applicator wheel means coupled to the first drive wheel means for rotating the first applicator wheel means at a rotational speed such that the surface of the first applicator wheel means moves at the predetermined surface speed; first engraved wheel means for applying base coat material to the first applicator wheel means; second drive wheel means for engaging the mandrel means to rotate the mandrel means to produce the predetermined surface speed of the can; second applicator wheel means coupled to the second drive wheel means for rotating the second applicator wheel means at a rotational speed such that the surface of the second applicator wheel means moves at the predetermined surface speed; second engraved wheel means for applying base coat material to the second applicator wheel means; turret means for transporting the mandrel means to engage the spin belt means and the first and second drive wheel means such that the beverage can contacts the first and second applicator wheel means at the predetermined surface speed for a predetermined number of revolutions of the beverage can; first motor means for driving the turret means at a plurality of inventory production speeds; second motor means for rotating the first and second drive wheel means at a plurality of operational speeds independently of the inventory production speed to apply a variable number of base coats to the beverage container proportional to the predetermined number of revolutions of the beverage can on the first and second applicator wheel means such that operational speeds can be maintained at a level sufficient to prevent misting and slinging of the base coat material; means for adjusting pressure of the first and second applicator wheel means on the beverage can; means for adjusting pressure of the first and second engraved wheel means on the first and second applicator wheel means; means for removing the first and second applicator wheel means from a position to apply the base coat material to the can when said inventory production speed is reduced to zero while maintaining operational speeds to prevent drying of base coat material on said first and second engraved wheel means and the first and second applicator wheel means.

The present invention may also comprise a method of applying a coating material to cylindrical objects comprising: mounting the cylindrical objects on mandrels; rotating the mandrels with a spin belt to achieve a predetermined surface speed of the cylindrical objects mounted on the mandrels; moving the mandrels at a predetermined inventory production speed along a predetermined path; automatically applying a coating material to multiple applicator wheels when the cylindrical objects are present on the mandrels; rotating the multiple applicator wheels at a predetermined rotational speed to produce a predetermined surface speed of the applicator wheels which is substantially equivalent to the predetermined surface speed of the cylindrical objects; automatically engaging the multiple applicator with the cylindrical objects along a portion of the predetermined path to apply the coating material to the cylindrical objects when the cylindrical objects are present on the mandrels; automatically disengaging the multiple applicator wheels and maintaining rotation of the multiple applicator wheels; independently controlling the predetermined surface speed and the predetermined inventory production speed.

OBJECTS OF THE INVENTION

It is therefore an object of the present invention to provide an improved base coat applicator.

Another object of the present invention is to provide an apparatus for applying coating material to a cylindrical object.

Another object of the present invention is to provide an apparatus for applying multiple base coats to a can at high inventory production speeds while maintaining operational speeds sufficiently slow to substantially eliminate misting and slinging of base coat material.

Another object of the present invention is to provide an apparatus for applying a variable number of multiple coats of base coat material to a beverage can independently of inventory production speed of the apparatus and for maintaining operational speeds of the apparatus sufficiently slow to prevent misting and slinging of base coat material while simultaneously operating the apparatus at high inventory production speeds.

Another object of the present invention is to provide a method of applying a coating material to cylindrical objects.

Additional objects, advantages and novel features of the invention are set forth in part in a description which follows and will be understood by those skilled in the art upon examination of the description or may be learned by practice of the invention. The objects and advantages of the invention may be realized and obtained by means of the instrumentalities and combinations particularly pointed out in the appended claims.

BRIEF DESCRIPTION OF THE DRAWINGS

An illustrative and presently preferred embodiment of the invention is shown in the accompanying drawings wherein.

DETAILED DESCRIPTION OF THE INVENTION

Figure 1:
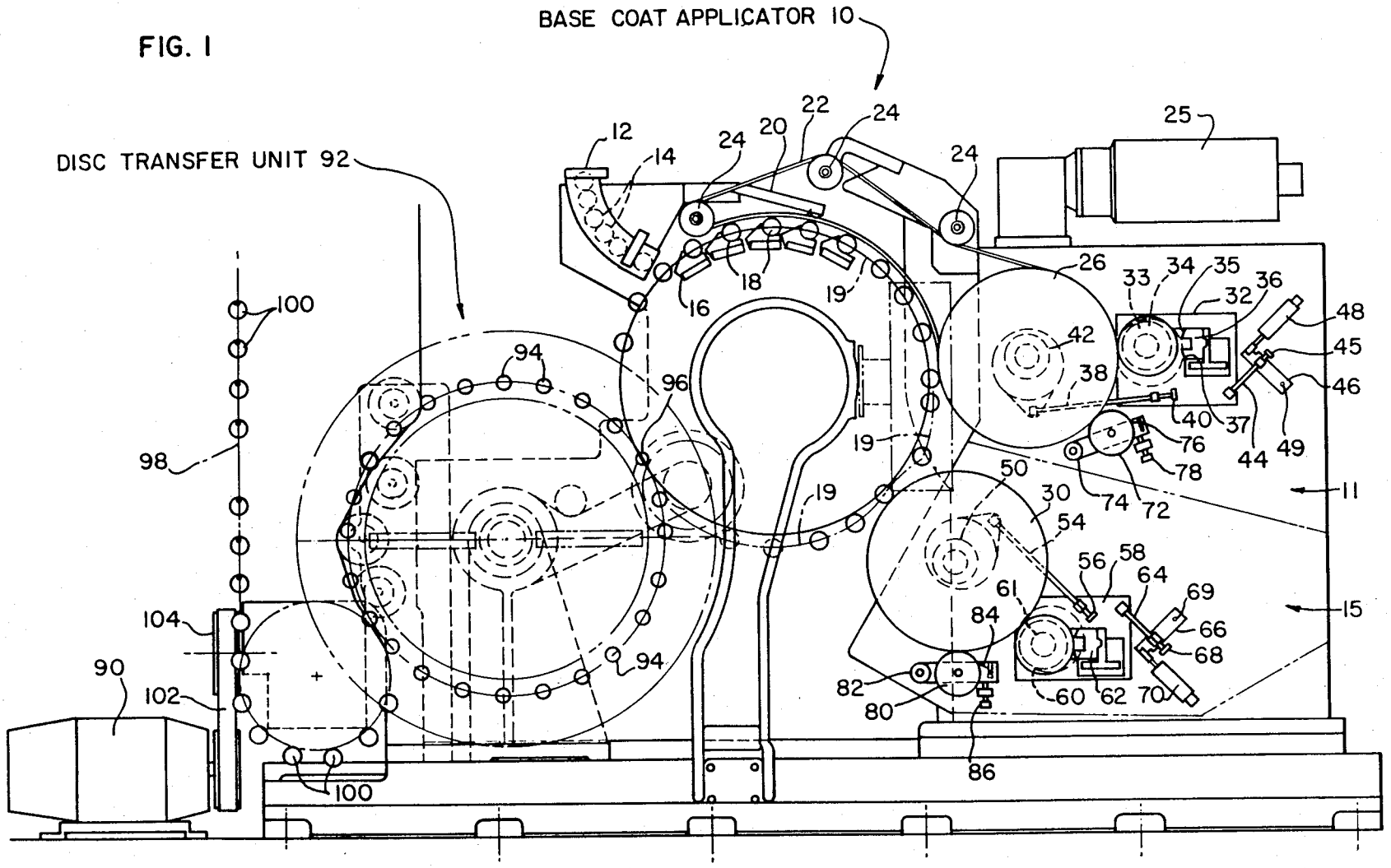
FIG. 1 comprises an elevation view of the apparatus of the present invention.
Figure 2:
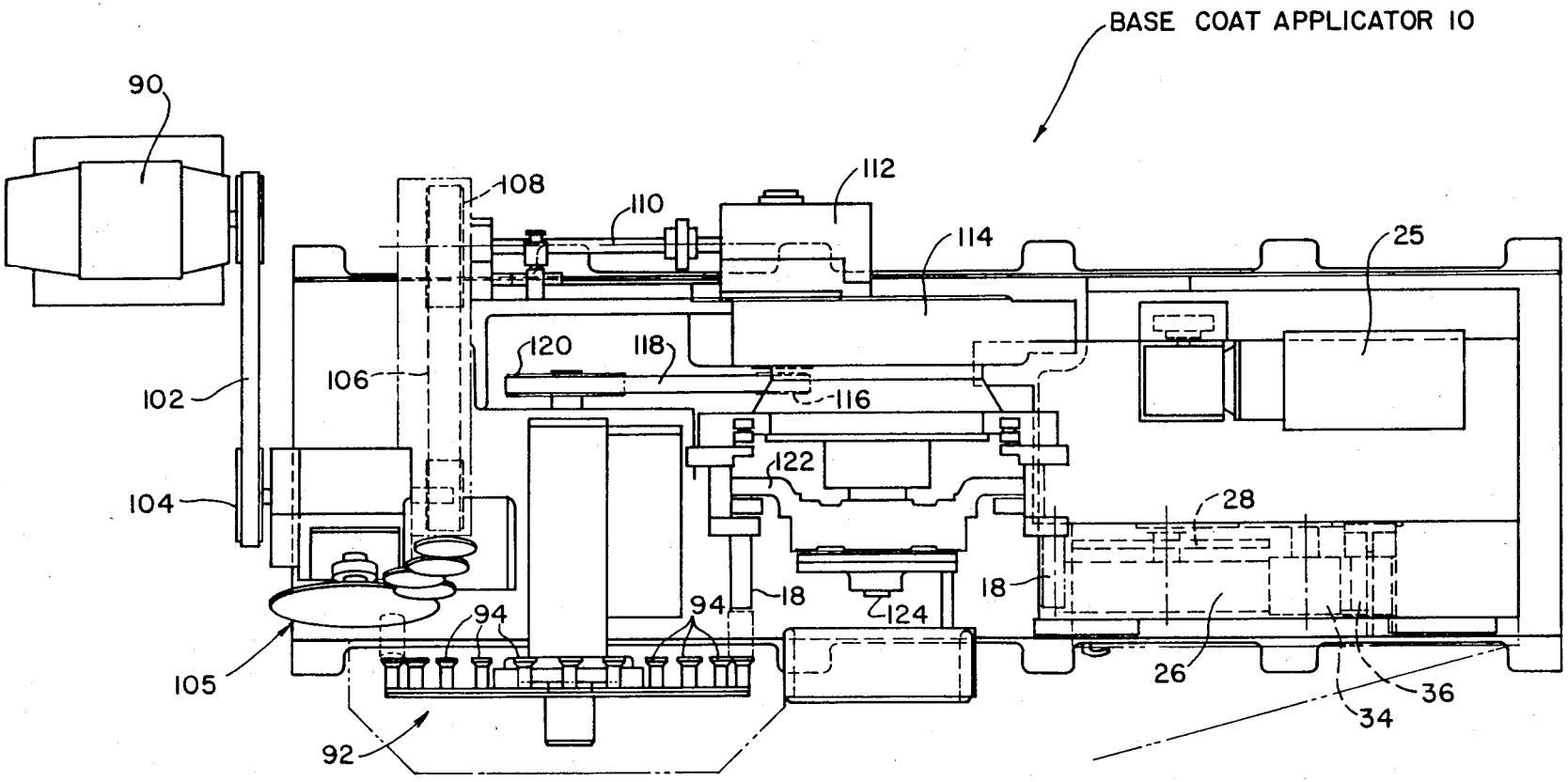
FIG. 2 comprises a plan view of the apparatus illustrated in FIG. 1.

FIG. 1 discloses the base coat applicator 10 of the present invention. Base coat applicator 10 uses an infeed chute 12 which is coupled directly to the input trackage system. Cans 14 are solidly loaded in the infeed chute and are engaged by mandrel turrets 16. Mandrels 18 engage cans 14 as mandrel turrets 16 move the cans along a predetermined path as schematically illustrated in FIG. 1. Spin belt 22 engages the mandrels 18 after cans 14 are loaded thereon. Pulleys 24 guide spin belt 22 such that it engages the mandrels for a predetermined distance. Spin belt 22 is then coupled to a drive wheel 28 (FIG. 2). Drive wheel 28 is slightly recessed from the diameter of applicator wheel 26 so that the outer surface of spin belt 22, when engaged with drive wheel 28, is substantially coextensive with the outer surface of applicator wheel 26. In this manner, the outer surface of spin belt 22 has a surface speed which is essentially the same as the surface speed of applicator wheel 26. Contact of the mandrel with the outer surface of spin belt 22 induces a rotary motion in mandrels 18 such that the mandrels 18 have a surface speed which is essentially the same as the surface speed of spin belt 22 and applicator wheel 26. Cans 14 mounted on mandrels 18 also have essentially the same surface speed.

Contact between spin belt 22 and mandrels 18 occurs over a predetermined distance to insure that the rotational speed of the mandrels 18 is increased from essentially a zero rotational speed to a rotational speed which prevents slippage between the surface of the cans and applicator wheel 26. The predetermined distance of engagement of the spin belt with the mandrels insures that the desired rotational speed is reached.

Mandrels 18 move along a predetermined path past proximity sensor 20 which detects the presence of a can 14 on a mandrel 18. Spin belt 22 releases the mandrels 18 at the same time mandrel 18 engages applicator wheel 26. The surface speed of applicator 26 is controlled by drive motor 25 which is independent of the movement of turret 16 and mandrels 18 along predetermined path 19.

Applicator wheel 26 pivots on eccentric 42 to engage the surface of cans 14 moving along predetermined path 19. The amount of pressure applied between the surface of applicator wheel 26 and cans 14 is controlled by adjustment screw 45 which controls the length of connecting rod 44. Connecting rod 44 controls the position of plate 32 on eccentric 33 which in turn controls the position of applicator wheel 26 by connecting rod 38 which is coupled to eccentric 42. Eccentric 42 controls the translational position of applicator wheel 26.

Base coat material is stored in fountain applicator 36 which applies base coat material directly to engraved wheel 34. Dual doctor blades 35 and 37 remove excess base coat material from the surface of applicator wheel 26. Engraved portions of engraved wheel 34 carry base coat material from fountain applicator 36 to the surface of applicator wheel 26. The pressure between engraved wheel 34 and applicator wheel 26 is controlled by connecting rod 38 and adjustment screw 40.

Air cylinder 48 is coupled to plate 46 which pivots on pivot 49 to induce motion in connecting rod 44 to move plate 32 on eccentric 33. The movement of plate 32 induces movement of connecting rod 38 which in turn moves applicator wheel 26. Consequently, air cylinder 48 controls the position of the entire applicator assembly 11 such that applicator wheel 26 can be placed in a position to engage cans 14 along a predetermined path 19, and also withdrawn from that position. During temporary shut down of the system, air cylinder 48 is actuated to withdraw the applicator assembly 11 from a position to apply base coat material to cans 14 but continues to operate (idle) such that paint does not dry on the surface of applicator wheel 26, which would otherwise delay restart of the system.

Scavenger wheel 72 functions to remove excess base coat material from the surface of applicator wheel 26. Scavenger wheel 72 pivots on pivot 74 to contact the surface of applicator wheel 26 with a pressure determined by adjustment 78. Doctor blade 76 removes excess material collected by scavenger wheel 72.

Applicator assembly 15 operates in the same fashion as applicator assembly 11. Connecting rod 54 provides a predetermined pressure between applicator wheel 30 and engraved wheel 60 by way of adjustment screw 56. Eccentrics 50 and 61 control the position of the assembly in response to movement induced by air cylinder 70 which is coupled through plate 66 on pivot 69 through connecting rod 64 to plate 58. Fountain applicator 62 provides base coat material to engraved wheel 60. Scavenger wheel 80 removes excess base coat material from the surface of applicator wheel 30. Excess base coat material is removed by doctor blade 84. Pressure between scavenger roller 80 and applicator wheel 30 is controlled by adjustment 86 which pivots on pivot 82.

After the can surface disengages from applicator wheel 26, the mandrels are free rotating and follow path 19 until the can surface engages with applicator wheel 30. Applicator wheel 30 has a drive wheel (not shown) which engages mandrels 18 to insure an identical surface speed between cans 14 mounted on mandrels 18 and applicator wheel 30.

The coated cans are then transported along predetermined path 19 which interfaces with disk transfer unit 92. Vacuum heads 94 of the disk transfer unit 92 align with the mandrels 18. Upon alignment at point 96, the can is blown from the mandrel onto the vacuum head to which the cans become secured. The cans are transported around the upper portion of disk transfer unit 92 in a counter clockwise direction. Disk transfer unit 92 aligns the cans with pins 100 of deco chain 98. Cans 14 are transferred to pins 100 and transported to an oven for curing.

Drive motor 25 controls the rotational speed of applicator wheels 26 and 30 independently of drive motor 90. Drive motor 90 controls the movement of mandrels 18 along predetermined path 19, disk transfer unit 92 and deco chain 98. In this manner, the number of coats applied by applicator wheels 26 and 30 can be controlled by controlling the speed of drive motor 25. The speed of operation of drive motor 25 is defined as the operational speed of base coat applicator 10 while the speed of operation of drive motor 90 is defined as the inventory production speed of base coat applicator 10.

The number of layers of base coat material applied to the cans is dependent upon the number of revolutions of the can on the surface of the applicator wheels 26 and 30. As drive motor 25 drives applicator wheels 26 and 30 at higher rotational speeds, a greater number of base coats will be applied by each of the applicator wheels. However, the number of revolutions of the can on the applicator wheels 26 and 30 is dependent upon the inventory production speed which is controlled by motor 90, since inventory production speed controls the time of contact of the cans with applicator wheels 26 and 30 as they proceed along predetermined path 19. Frequently, it is desired to operate the system at high inventory production speeds and also apply numerous layers of base coat material to the cans. In such a case, applicator wheels 26 and 30 must rotate at high rotational speeds to apply the desired number of layers of base coat material. Since two applicator wheels 26 and 30 are utilized, the surface speed of applicator wheels 26 and 30 is essentially one half of the surface speed which would be required by a single applicator wheel. Consequently, twice as much base coat material can be applied for a given surface speed. In cases where numerous layers of base coat material are required on the can, misting and slinging of base coat material can be prevented because of the lower surface speeds of applicator wheels 26 and 30 required to apply a given number of base coat layers.

FIG. 2 is a plan view of the device illustrated in FIG. 1. Drive motor 90 is coupled to drive belt 102 which drives pulley 104, which in turn drives the deco chain interface 105. Cans are transferred from disk transfer unit 92 by deco chain interface 105 for placement on the deco pin chain. Power is then coupled through drive belt 106 to pulley 108 which drives shaft 110 to gear box 112 and 114. Gear box 114 drives shaft 124 which rotates the turret 122. Power is also coupled through pulley 116 to drive belt 118 and pulley 120 which supplies a rotational force to disk transfer unit 92. Also illustrated in FIG. 2 is applicator wheel 26 which is coupled to drive wheel 28. Engraved wheel 34 and fountain applicator 36 are also illustrated in association with applicator wheel 26.

Figure 3:
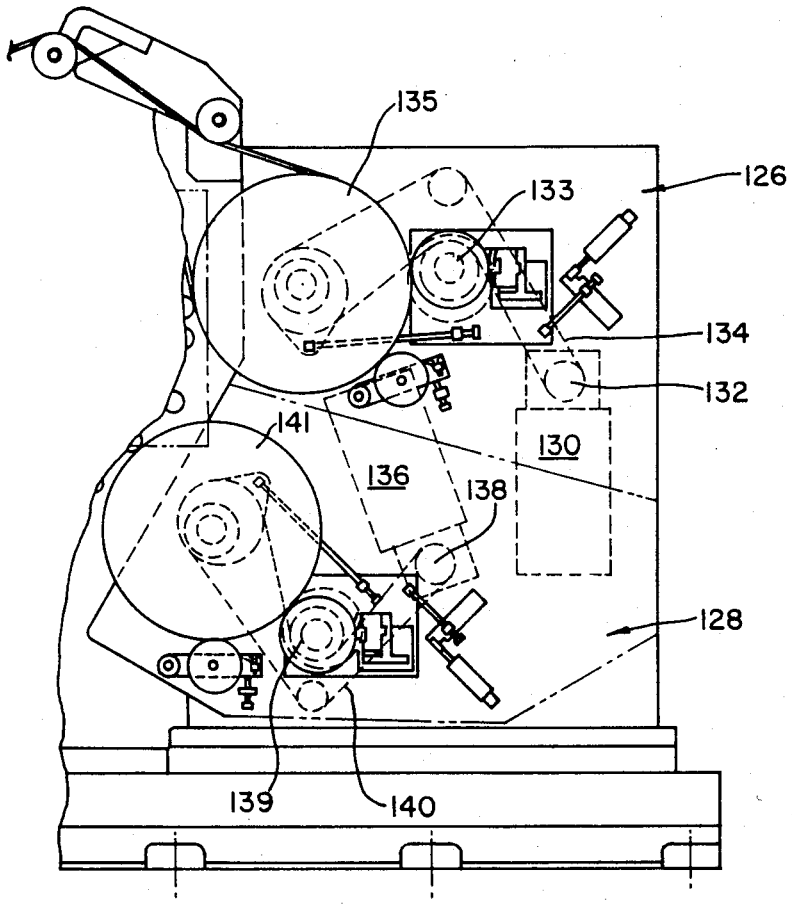
FIG. 3 comprises a partial elevation view of an alternative embodiment of the present invention.
Figure 4:
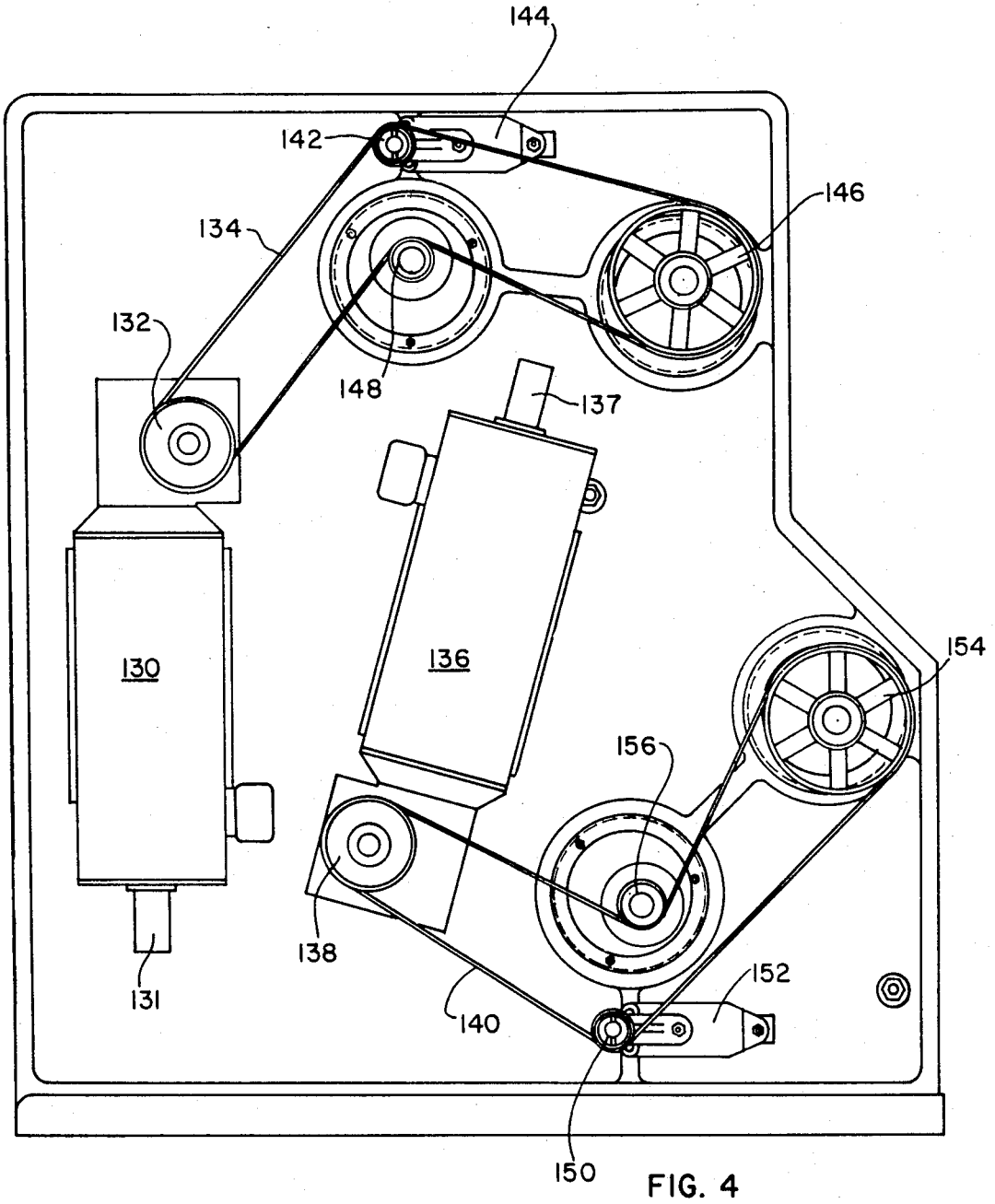
FIG. 4 comprises a reverse detailed elevation view of portions of the invention illustrated in FIG. 3.

FIGS. 3 and 4 disclose an alternative embodiment wherein drive motor 25 of the embodiment of FIGS. 1 and 2 is replaced by drive motors 130 and 136 which are used to control the rotational speed of applicator assemblies 126 and 128, respectively. As illustrated in FIG. 3, drive motor 130 has a drive pulley 132 which drives a drive belt 134 to control the rotational speed of applicator wheel 135. Similarly, applicator assembly 128 utilizes a separate drive motor 136 which drives a drive pulley 138 to drive a drive belt 140 to control the rotational speed of applicator wheel 141.

FIG. 4 comprises a reverse detailed elevation view of the separate drive assemblies illustrated in FIG. 3. As shown in FIG. 4, power from drive motor 132 is coupled to drive belt 134 through drive pulley 132. Idler pulley 142 directs drive belt 134 to drive pulley 146 which drives applicator wheel 135. Adjuster 144 controls the tension of drive belt 134 by adjusting the position of idler pulley 142. Drive belt 134 also engages drive pulley 148 which drives engraved wheel 133. Drive motor 130 has a tachometer 131 which indicates the operational speed of applicator assembly 126. Applicator assemblies 126 and 128 function in the same manner as applicator assemblies 11 and 15 of the embodiment of FIGS. 1 and 2, with the exception of the drive mechanism utilized in the embodiments of FIGS. 3 and 4.

In a similar manner, drive motor 136 drives belt 140 by way of drive pulley 138. Drive belt 140 is coupled to idler pulley 150 which is adjusted by pulley adjustment 152 to maintain proper tension on drive belt 140. Drive belt 140 applies power to drive pulley 154 which drives applicator wheel 141. Drive belt 140 also drives pulley 156 to drive engraved wheel 139. The operational speed of drive motor 136 is indicated by tachometer 137.

The advantage of the embodiment of FIGS. 3 and 4, is that the operational speed of applicator assemblies 126 and 128 can be controlled independently to apply a variable number of base coat layers by applicator wheels 135 and 141. The operational speed of drive motors 130 and 136 can be independently controlled by standard motor speed control devices.

The present invention therefore provides an apparatus which is capable of independently controlling operational speed and inventory production speed. This allows any desired number of base coat layers to be applied to a can independently of the speed at which the cans are being processed by the device, i.e., the inventory production speed. Additionally, the present invention utilizes two applicator wheels to substantially reduce applicator surface wheel speed, and consequently provides for the application of numerous base coat layers while preventing misting and slinging of base coat material. Also, the present invention provides for automatic withdrawal of the applicator wheels 26 and 30 by air cylinders 48 and 70 whenever a supply of cans is not present in the in-feed chute 12. The operator may also signal the air cylinders 48 and 70 to withdraw the applicator wheels at any desired time to make adjustments or check the machinery. In both cases, the applicator assemblies continue to idle to prevent base coat material from drying on the various surfaces of the applicator assembly 11.

The present invention also utilizes a spin belt 22 to initiate rotation of the mandrel so that there is no slippage between the cans and applicator wheel during engagement of the mandrel with the drive wheel. This prevents smearing of base coat material on the surface of the can resulting from a lack of synchronization of surface speeds of the can and applicator wheel.

The foregoing description of the invention has been presented for purposes of illustration and description. It is not intended to be exhaustive or to limit the invention to the precise form disclosed, and modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An apparatus for applying multiple base coats to a cylindrical container at high inventory production speeds while maintaining operational speeds sufficiently slow to substantially eliminate misting and slinging of base coat material comprising:

mandrel means for holding said container on a rotatable axis;

turret means for transporting said mandrel means along a predetermined path;

spin belt means for rotating said mandrel means by contacting said mandrel means while said spin belt means is moving;

applicator assembly means disposed to contact said container along predetermined portions of said predetermined path to apply said base coat material to said container;

additional applicator assembly means disposed to contact said container along additional predetermined portions of said predetermined path to apply additional coats of said base coat material to said container, whereby said applicator assembly means and said additional applicator assembly means are capable of applying equivalent amounts of base coat material to said container as a single applicator assembly operating at twice the rotational speed of said applicator assembly means and said additional applicator assembly means;

drive means for varying inventory production speed and operational speed independently to control the amount of said base coat material applied to said container independently of said inventory production speed;

means for removing said applicator wheel means from said predetermined portions of said predetermined path and said additional applicator wheel means from said additional predetermined portions of said predetermined path while maintaining said operational speed to prevent drying of base coat material on said applicator assembly means regardless of said inventory production speed.

2. The apparatus of claim 1 wherein said applicator assembly means and said additional applicator assembly means comprises:

applicator wheel means for applying base coat material to said cylindrical container;

engraved wheel means for applying said base coat material to said applicator wheel means and said engraved wheel means.

3. The apparatus of claim 2 wherein said drive means comprises:

first motor means for driving said turret means at various inventory production speeds;

second motor means for rotating said mandrel means, spin belt means applicator wheel means, and additional applicator wheel means at an operation speed which is independent of said inventory production speed.

4. The apparatus of claim 3 wherein said second motor means comprises:

first applicator assembly drive motor means for driving said applicator assembly means at a first predetermined operational speed;

second applicator assembly drive motor means for driving said additional applicator assembly means at a second predetermined operational speed.

5. An apparatus for applying a variable number of multiple coats of base coat material to a beverage can independently of inventory production speed of said apparatus and for maintaining operational speeds of said apparatus sufficiently slow to prevent misting and slinging of said base coat material while simultaneously operating said apparatus at high inventory production speeds comprising:

mandrel means for holding said can;

spin belt means for initiating rotational motion of said mandrel means by movement of said spin belt in contact with mandrel means to provide a predetermined rotational speed of said mandrel means;

first drive wheel means for engaging said mandrel means to rotate said mandrel means at said predetermined rotational speed sufficient to produce a predetermined surface speed of said beverage can;

first applicator wheel means coupled to said first drive wheel means for rotating said first applicator wheel means at a rotational speed such that the surface speed of said first applicator wheel means is essentially equal to said predetermined surface speed;

first engraved wheel means for applying base coat material to said first applicator wheel means;

second drive wheel means for engaging said mandrel means to rotate said mandrel means to produce a second predetermined surface speed of said can;

second applicator wheel means coupled to said second drive wheel means for rotating said second applicator wheel means at a rotational speed such that the surface speed of said second applicator wheel means is essentially equal to said second predetermined surface speed;

second engraved wheel means for applying base coat material to said second applicator wheel means;

turret means for transporting said mandrel means to engage said spin belt means and said first and second drive wheel means such that said beverage can contacts said first applicator wheel means at said first predetermined surface speed for a predetermined number of revolutions of said beverage can;

first motor means for driving said turret means at a plurality of inventory production speeds;

second motor means for rotating said first and second drive wheel means at a plurality of operational speeds independently of said inventory production speed to apply a variable number of base coats to said beverage container proportional to said predetermined number of revolutions of said beverage can on said first and second applicator wheel means such that operational speeds can be maintained at a level sufficient to prevent misting and slinging of said base coat material;

means for adjusting pressure of said first and second applicator wheel means on said beverage can;

means for adjusting pressure of said first and second engraved wheel means on said first and second applicator wheel means;

means for removing said first and second applicator wheel means from a position to apply said base coat material to said can when said inventory production speed is reduced to zero while maintaining operational speeds to prevent drying of base coat material on said first and second engraved wheel means and said first and second applicator wheel means.

6. The apparatus of claim 5 wherein said second motor means comprises:

first applicator assembly drive motor means for driving said first drive wheel means, said first applicator wheel means and said first engraved wheel means at a first predetermined operational speed;

second applicator assembly drive motor means for driving said second drive wheel means, said second applicator wheel means and said second engraved wheel means at a second predetermined operational speed.

7. A method of applying a coating material to cylindrical containers at high inventory production speeds while maintaining operational speeds sufficiently slow to substantially eliminate misting and slinging of base coat material comprising:

mounting said cylindrical containers on mandrels;

rotating said mandrels with a spin belt to achieve a predetermined surface speed of said cylindrical containers mounted on said mandrels;

moving said mandrels at a predetermined inventory production speed along a predetermined path;

automatically applying a coating material to multiple applicator wheels when said cylindrical containers are present on said mandrels;

rotating said multiple applicator wheels at least one predetermined rotational speed to produce a first predetermined surface speed on a first applicator wheels which is substantially equivalent to said predetermined surface speed of said cylindrical containers;

automatically engaging said multiple applicator with said cylindrical containers along a portion of said predetermined path to apply said coating material to said cylindrical containers when said cylindrical containers are present on said mandrels;

automatically disengaging said multiple applicator wheels from said cylindrical containers and maintaining rotation of said multiple applicator wheels;

maintaining engagement of said multiple applicator wheels with an engraved wheel which applies said coating material to said multiple applicator wheel to prevent drying of said coating material on said multiple applicator wheels during disengagement of said multiple applicator wheels with said cylindrical containers;

independently controlling said predetermined surface speed and said predetermined inventory production speed to control the amount of said coating material applied to said cylindrical containers independently of said inventory production speed.

8. The method of claim 7 wherein said step of rotating said multiple applicator wheels at at least one predetermined rotational speed further comprises the steps of:

rotating said first applicator wheel at a first operational speed;

rotating a second applicator wheel at a second operational speed.

9. An apparatus for applying multiple base coats to a cylindrical container at high inventory production speeds while maintaining operational speeds sufficiently slow to substantially eliminate misting and slinging of base coat material comprising:

mandrel means for holding said container on a rotatable axis;

turret means for transporting said mandrel means along a predetermined path;

spin belt means for rotating said mandrel means by contacting said mandrel means while said spin belt means is moving;

applicator assembly means disposed to contact said container along predetermined portions of said predetermined path to apply said base coat material to said container;

additional applicator assembly means disposed to contact said container along additional predetermined portions of said predetermined path to apply additional coats of said base coat material to said container, whereby said applicator assembly means and said additional applicator assembly means are capable of applying a variable number of base coats to said beverage container proportional to a predetermined number of revolutions of said beverage container on said applicator assembly means and said additional applicator assembly means such that operational speeds can be maintained at a level sufficient to prevent misting and slinging of said base coat material;

drive means for varying inventory production speed and operational speed independently to control the amount of said base coat material applied to said container independently of said inventory production speed;

means for removing said applicator wheel means from said predetermined portions of said predetermined path and said additional applicator wheel means from said additional predetermined portions of said predetermined path while maintaining said operational speed to prevent drying of base coat material on said applicator assembly means regardless of said inventory production speed.

10. The apparatus of claim 9 wherein said applicator assembly means and said additional applicator assembly means comprises:

applicator wheel means for applying base coat material to said cylindrical container;

engraved wheel means for applying said base coat material to said applicator wheel means and said engraved wheel means.

11. The apparatus of claim 10 wherein said drive means comprises:

first motor means for driving said turret means at various inventory production speeds;

second motor means for rotating said mandrel means, spin belt means applicator wheel means, and additional applicator wheel means at an operation speed which is independent of said inventory production speed.

12. The apparatus of claim 11 wherein said second motor means comprises:

first applicator assembly drive motor means for driving said applicator assembly means at a first predetermined operational speed;

second applicator assembly drive motor means for driving said additional applicator assembly means at a second predetermined operational speed.

* * * * *